US010850168B2

(12) United States Patent
Kato

(10) Patent No.: US 10,850,168 B2
(45) Date of Patent: Dec. 1, 2020

(54) GOLF CLUB HEAD

(71) Applicant: SUMITOMO RUBBER INDUSTRIES, LTD., Kobe (JP)

(72) Inventor: Masatoshi Kato, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 16/031,653

(22) Filed: Jul. 10, 2018

(65) Prior Publication Data

US 2019/0015714 A1 Jan. 17, 2019

(30) Foreign Application Priority Data

Jul. 11, 2017 (JP) ..... 2017-135653

(51) Int. Cl.
*A63B 53/04* (2015.01)

(52) U.S. Cl.
CPC ..... *A63B 53/0466* (2013.01); *A63B 53/0408* (2020.08); *A63B 53/0412* (2020.08); *A63B 53/0437* (2020.08)

(58) Field of Classification Search
CPC ..... A63B 53/0466; A63B 2053/0412; A63B 53/0408; A63B 53/0412; A63B 53/0437
USPC ..... 473/345
See application file for complete search history.

(56) References Cited

U.S. PATENT DOCUMENTS 6,402,639 B1 * 6/2002 Iwata ..... A63B 53/0466 473/330
2004/0023730 A1 * 2/2004 Nagai ..... A63B 53/04 473/345
2009/0181789 A1 * 7/2009 Reed ..... A63B 53/0466 473/290
2011/0136584 A1 * 6/2011 Boyd ..... A63B 53/02 473/327
2015/0126296 A1 * 5/2015 Fossum ..... A63B 53/0466 473/290
2015/0265885 A1 * 9/2015 Hettinger ..... A63B 53/0466 473/291
2016/0346643 A1 * 12/2016 Akiyama ..... A63B 53/0466
2017/0151472 A1 * 6/2017 Beach ..... A63B 60/52

FOREIGN PATENT DOCUMENTS

JP 2005-312942 A 11/2005

* cited by examiner

*Primary Examiner* — Michael D Dennis
(74) *Attorney, Agent, or Firm* — Birch, Stewart, Kolasch & Birch, LLP

(57) ABSTRACT

The golf club head according to the present invention is a golf club head including a face portion, a crown portion, a sole portion, and a hosel portion configured to accept insertion of a shaft. A reference sole line of intersection which is a line of intersection between a plane containing a central axis of the shaft and perpendicular to a setting surface and a surface of the sole portion with the golf club head in a reference state is prescribed, and a curvature radius of a circular arc that passes through three points on the reference sole line of intersection respectively corresponding to a face center, a position 25 mm from the face center on a toe side and a position 25 mm from the face center on a heel side is 5.0 to 6.0 inches.

3 Claims, 6 Drawing Sheets

E1 Cross-section

GOLF CLUB HEAD

TECHNICAL FIELD

The present invention relates to a golf club head.

BACKGROUND ART

Many improvements have been made to wood-type golf club heads heretofore, and with a golf club head disclosed in JP 2005-312942A, for example, a plurality of regions having a thin wall thickness are formed, thereby achieving a reduction in the weight of the crown portion and realizing a lower center of gravity.

JP 2005-312942A is an example of related art.

SUMMARY OF THE INVENTION

However, there is room for improvement in increasing the carry distance achieved by reducing the center of gravity, and it is desired to further increase the carry distance. The present invention was made in order to solve the above problem, and an object thereof is to provide a golf club head that is able to further increase the carry distance.

A golf club head according to the present invention is a golf club head provided with a face portion, a crown portion, a sole portion and a hosel portion configured to accept insertion of a shaft. A reference sole line of intersection which is a line of intersection between a plane containing a central axis of the shaft and perpendicular to a setting surface and a surface of the sole portion with the golf club head in a reference state is prescribed, and a curvature radius of a circular arc that passes through three points on the reference sole line of intersection respectively corresponding to a face center, a position 25 mm from the face center on a toe side and a position 25 mm from the face center on a heel side is 5.0 to 6.0 inches. Also, a relationship between a height T of a back-side end portion of the golf club head in the reference state from the setting surface and a height B from the setting surface of the golf club head in the reference state to an uppermost point of the crown portion satisfies $T/B \leq 0.3$, and a relationship between a height NE from the setting surface of the golf club head in the reference state to an uppermost point of the hosel portion and the height B satisfies $NE/B \leq 1.25$.

In the above golf club head, the height T can be set to 13 mm or less.

In the above golf club heads, the height B can be set to 40 mm or less.

In the above golf club heads, the height NE can be set to 44 mm or less.

In the above golf club heads, a height SH of a sweet spot of the face portion from the setting surface can be set to 24.5 mm or less.

In the above golf club heads, a height GH of a center of gravity of the golf club head in the reference state from the setting surface can be set to 17 mm or less.

In the above golf club heads, a length X in a face-back direction between a face-side end portion of the golf club head in the reference state and the center of gravity can be set to 28 mm or more.

The above golf club heads can include a head main body having a back-side crown portion that constitutes a back-side part of the crown portion and a back-side sole portion that constitutes a back-side part of the sole portion, and having an opening enclosed by the back-side crown portion and the back-side sole portion, and a cup-shaped face member having the face portion and a peripheral portion extending from a periphery of the face portion, and the peripheral portion can constitute a face-side part of the crown portion and a face-side part of the sole portion, and the face member can be configured to close off the opening in the head main body.

The above golf club heads can be a fairway wood or a hybrid.

A golf club head according to the present invention enables the carry distance to be further increased.

EMBODIMENTS OF THE INVENTION

Hereinafter, an embodiment of a golf club head according to the present invention will be described, with reference to the drawings.

1. Overview of Golf Club Head

Figure 1:
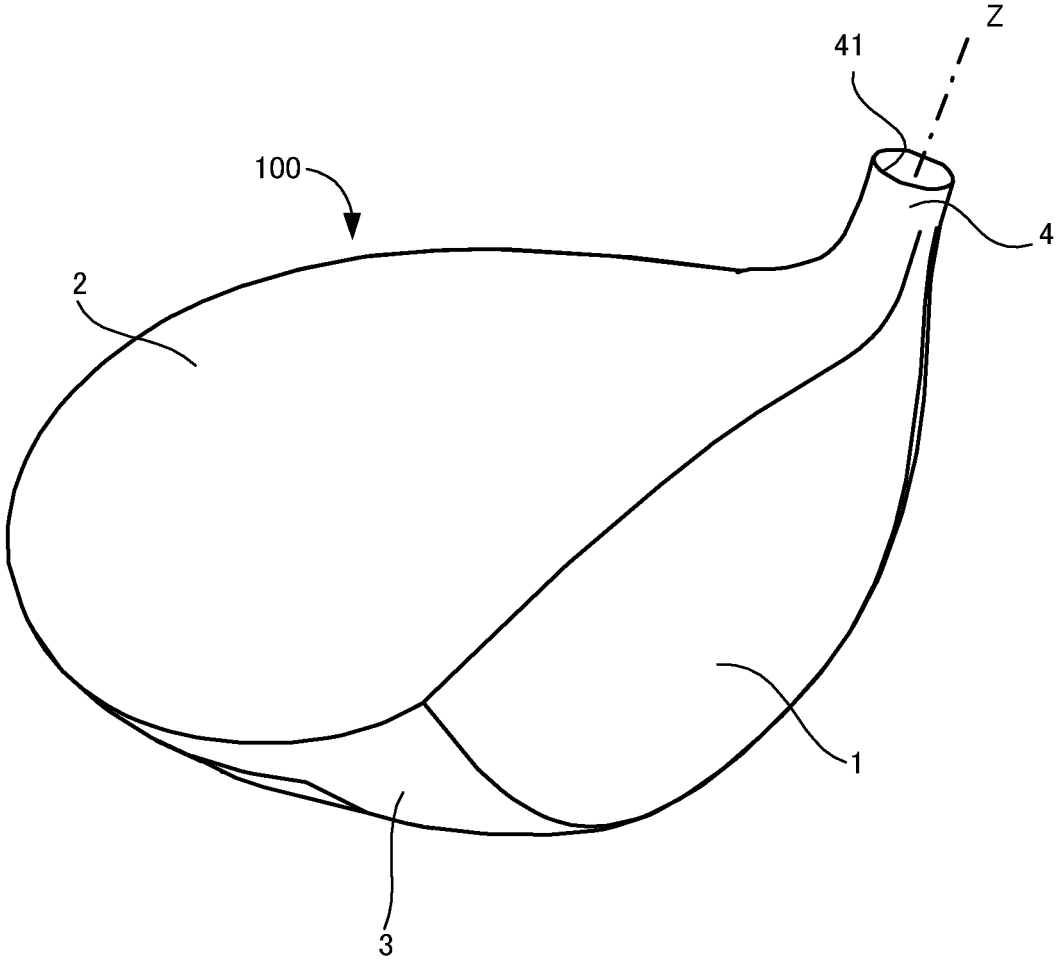
FIG. 1 is a perspective view of a reference state of a golf club head according to one embodiment of the present invention.
Figure 2:
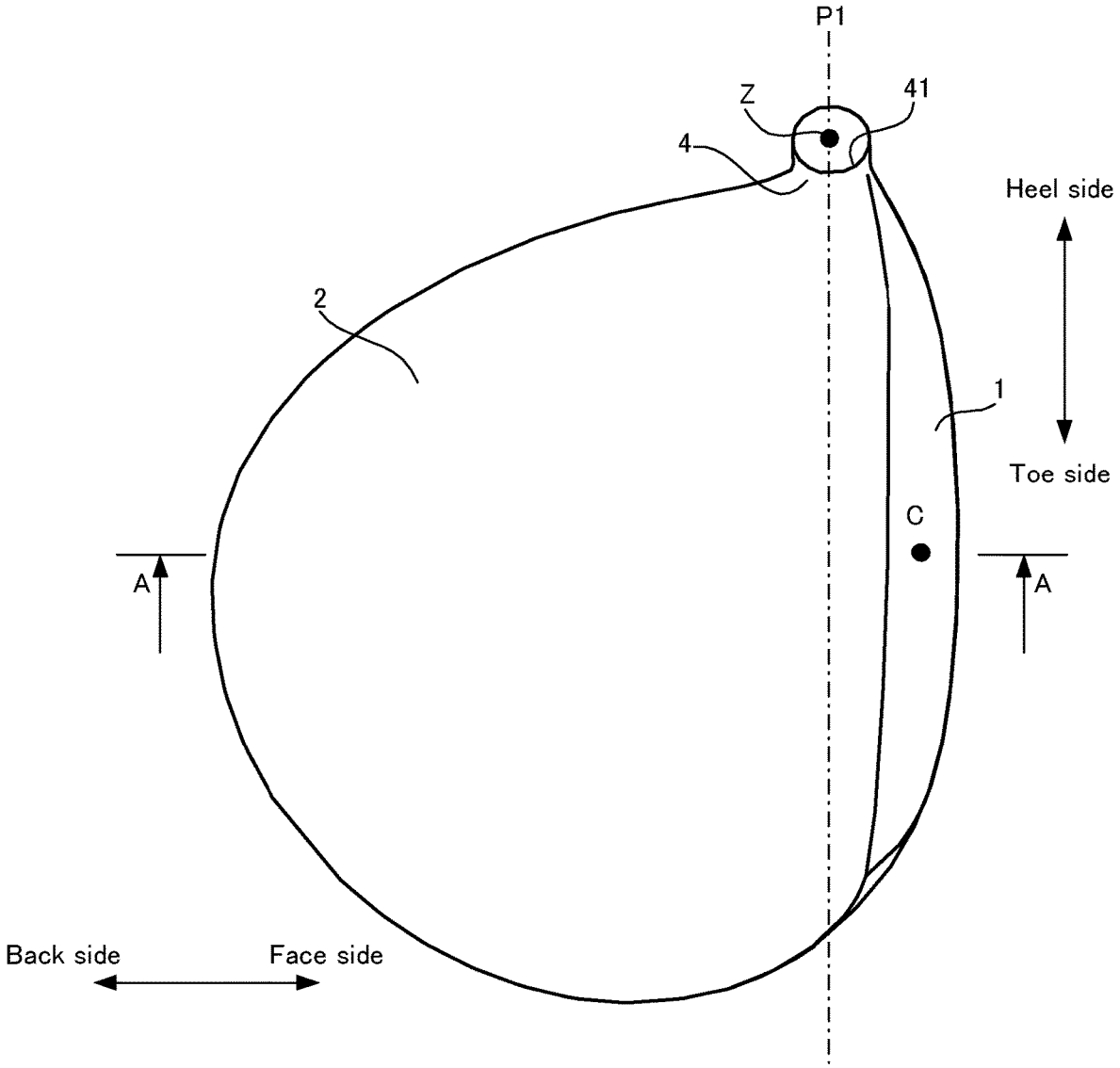
FIG. 2 is a plan view of FIG. 1.
Figure 3:
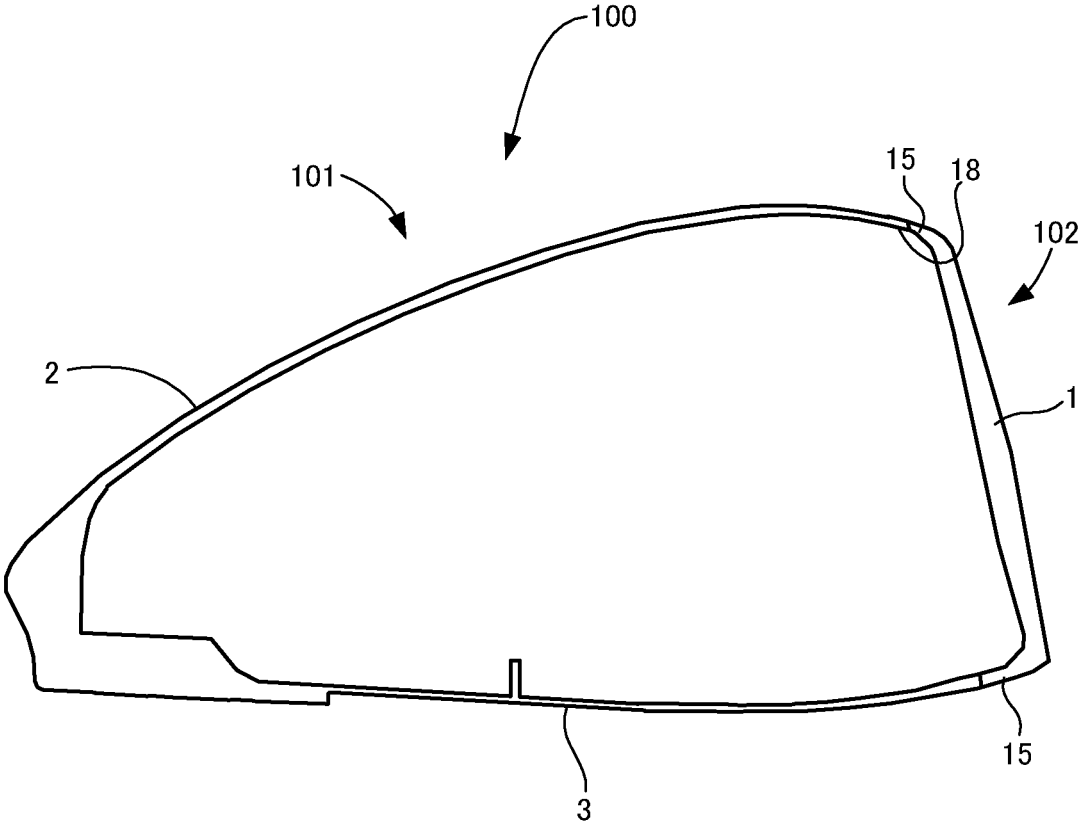
FIG. 3 is a cross-sectional view taken along an A-A line in FIG. 2.

FIG. 1 is a perspective view of this golf club head, FIG. 2 is a plan view of the head in a reference state, and FIG. 3 is a cross-sectional view taken along an A-A line in FIG. 2. As shown in FIGS. 1 to 3, this golf club head (hereinafter, may be referred to simply as "head") 100 is a wood-type golf club head having a hollow structure with an internal space, and a wall surface is formed by a face portion 1, a crown portion 2, a sole portion 3 and a hosel portion 4. Specifically, the present invention can be applied to golf club heads such as hybrids, fairway woods and drivers.

The face portion 1 has a face surface which is the surface that hits the ball, and the crown portion 2 adjoins the face portion 1 and constitutes the upper surface of the head 100. The sole portion 3 mainly constitutes the bottom surface of the head 100, and constitutes the outer peripheral surface of the head 100 other than the face portion 1 and the crown portion 2. That is, besides the bottom surface of the head 100, the region extending from the toe side of the face portion 1 around the back side of the head to the heel side of the face portion 1 is also part of the sole portion 3. Furthermore, the hosel portion 4 is a region that is provided adjoining the heel side of the crown portion 2, and has an insertion hole 41 into which the shaft (illustration omitted) of the golf club is inserted. A center axis line Z of this insertion hole 41 coincides with the axis line of the shaft.

Here, the reference state when setting the golf club head 100 on the ground will be described. First, as shown in FIG. 2, a state where the above center axis line Z is contained in a plane P1 that is perpendicular to the ground and the head is placed on the ground (horizontal surface) at a predetermined lie angle and real loft angle is prescribed as the reference state. The above plane P1 will be referred to as the reference perpendicular plane. Also, as shown in FIG. 2, the direction of the line of intersection between the above reference perpendicular plane P1 and the ground will be referred to as the toe-heel direction, and the direction that is perpendicular to this toe-heel direction and parallel to the ground will be referred to as the face-back direction. Also, the direction that is orthogonal to the toe-heel direction and the face-back direction may be referred to as the up-down direction.

Figure 4A:
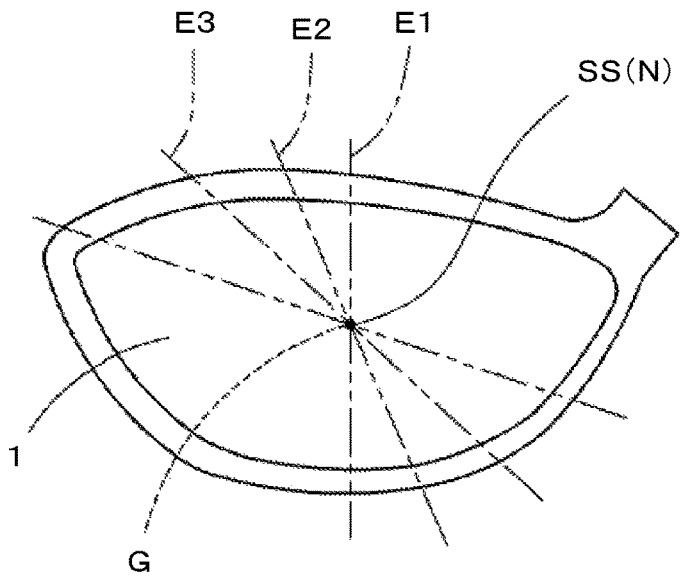
FIG. 4A is a diagram illustrating the boundary of a face portion.
Figure 4B:
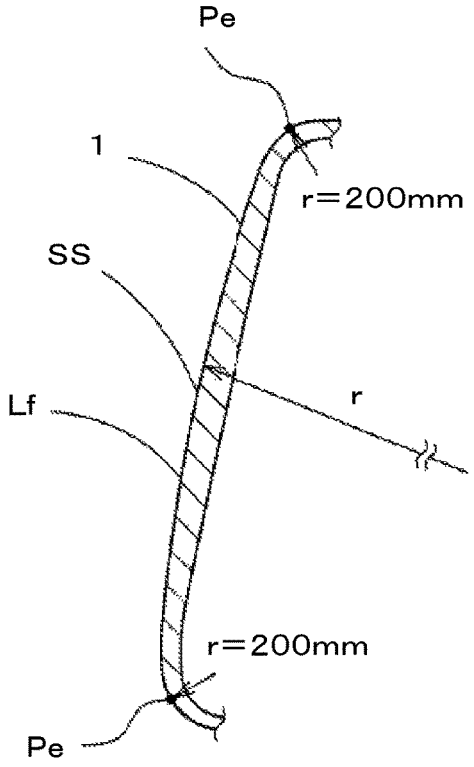
FIG. 4B is a diagram illustrating the boundary of the face portion.

In the present embodiment, the boundary between the face portion 1 and the crown portion 2 and between the face portion 1 and the sole portion 3 can be defined as follows. That is, in the case where a ridgeline is formed therebetween, this ridgeline will be the boundary. On the other hand, in the case where a clear ridgeline is not formed, in each of cross-sections E1, E2, E3 and so forth that contain a straight line N connecting a head center of gravity G and a sweet spot SS, as shown in FIG. 4A, a position Pe at which a curvature radius r of a contour line Lf of the face outer surface first reaches 200 mm in a direction toward the face outer side from the sweet spot side, as shown in FIG. 4B, will be the periphery of the face portion 1, and this periphery is defined as the boundary with the crown portion 2 or the sole portion 3. Note that the sweet spot SS is the point of intersection between the normal (straight line N) of the face surface that passes through the head center of gravity G and this face surface.

Also, in the present embodiment, the boundary between the crown portion 2 and the sole portion 3 can be defined as follows. That is, in the case where a ridgeline is formed between the crown portion 2 and the sole portion 3, this ridgeline will be the boundary. On the other hand, in the case where a clear ridgeline is not formed therebetween, the contour when the head is set in the reference state and viewed from directly above the center of gravity of the head 100 will be the boundary.

FIG. 3 is a cross-section in the face-back direction passing through a face center C. The face center C is a point in a vicinity of the center of the face portion 1 where the ball tends to be impact, and can be defined as follows. First, an arbitrary point Po is determined generally in a vicinity of the middle of the face portion 1 (face surface) in the toe-heel direction and the up-down direction. A line x extending in the toe-heel direction is drawn through this point Po, and a midpoint Px of this line x is determined. Next, on the face portion 1, a line y extending in the up-down direction is drawn through the point Px, and a midpoint Py of this line is determined. A process of redrawing the line extending in the toe-heel direction through the point Py determined in this way as the line x and thereinafter redetermining the point Py in a similar manner to that described above is then repeatedly performed. A new point Py at which the distance between the previous point Py and the new point Py becomes 0.5 mm or less during repetition of this process is defined as the face center. Note that, more specifically, the above line x passing through the point Po is the line of intersection between the face surface (surface of the face portion 1) and a plane that contains the normal of the face surface passing through this point Po and is parallel to the toe-heel direction. Also, more specifically, the above line y passing through the point Px is the line of intersection between the face surface and a plane that contains the normal of the face surface passing through this point Px and is parallel to the up-down direction. Also, more specifically, the above line x passing through the point Py is the line of intersection between the face surface and a plane that contains the normal of the face surface passing through this point Py and is parallel to the toe-heel direction. Note that the lengths of the above lines x and y are measured along the face surface.

Also, the head 100 can, for example, be formed with a titanium alloy (Ti-6Al-4V, Ti-8Al-1Mo-1V, etc.) having a specific gravity of substantially about 4.3 to 4.5. Also, apart from a titanium alloy, the head can also be formed using one or two or more materials selected from stainless steel, maraging steel, an aluminum alloy, a magnesium alloy and an amorphous alloy, for example.

Also, the volume of this golf club head 100 is desirably from 90 $cm^3$ to 470 $cm^3$ inclusive, for example. Also, volume of a golf club head that is applied to a fairway wood or a hybrid can be set from 90 to 230 $cm^3$.

2. Assembly Structure of Golf Club Head

The golf club head 100 according to the present embodiment is constituted, as shown in FIG. 3, by assembling a head main body 101 having a crown portion 2 and a sole portion 3 and a cup-shaped face member 102 having a face portion 1 and a peripheral portion 15 extending from the periphery of the face portion. This head main body 101 has an opening 18 enclosed by a back-side part of the crown portion 2 (back-side crown portion) and a back-side part of the sole portion 3 (back-side sole portion), and the face member 102 is attached so as to close off this opening 18. That is, an end face of the peripheral portion 15 of the face member 102 is butted against an end face of the opening 18 of the head main body 101, and these portions are joined by welding (so-called cup face structure). The face member 102 is integrated with the head main body 101, by being attached to an edge portion of the opening 18 of the head main body 101, and the peripheral portion 15 of the face member 102 thereby functions as part of the crown portion 2 and the sole portion 3 of the head 100.

Accordingly, the surface that is integrally formed as a result of the peripheral portion 15 of the face member 102 being attached to the head main body 101 constitutes the crown portion 2 and the sole portion 3 of the head 100. Thus, strictly speaking, the crown portion (back-side crown portion) 2 and the sole portion (back-side sole portion) 3 of the head main body 101 are part of the crown portion 2 and the sole portion 3 of the head 100, although, in this specification, these portions of the head main body 101 may also be referred to simply as the crown portion 2 and the sole portion 3, without making this distinction.

3. Shape of Head

Figure 5:
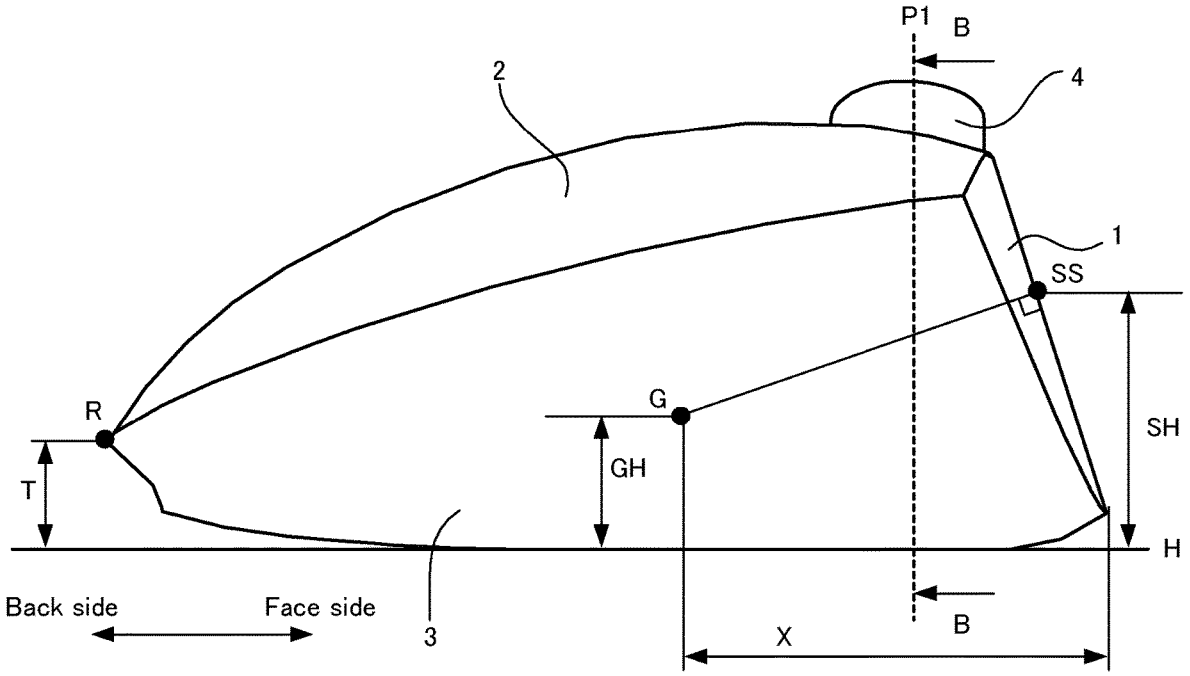
FIG. 5 is a side view of the head in FIG. 1.
Figure 6:
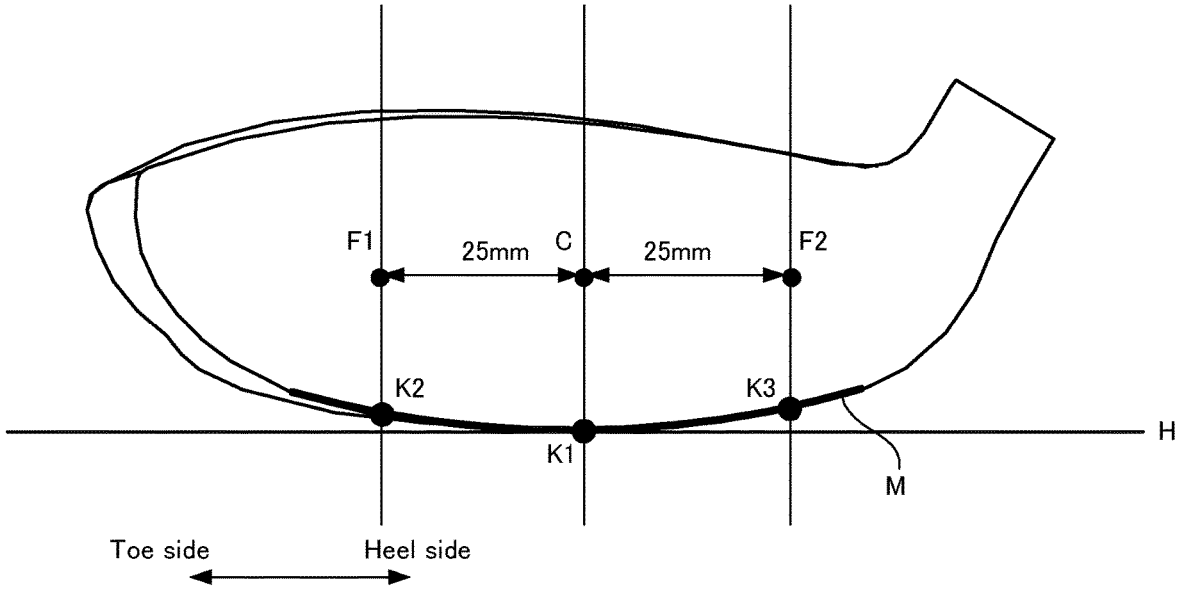
FIG. 6 is a cross-sectional view taken along a B-B line in FIG. 5.
Figure 7:
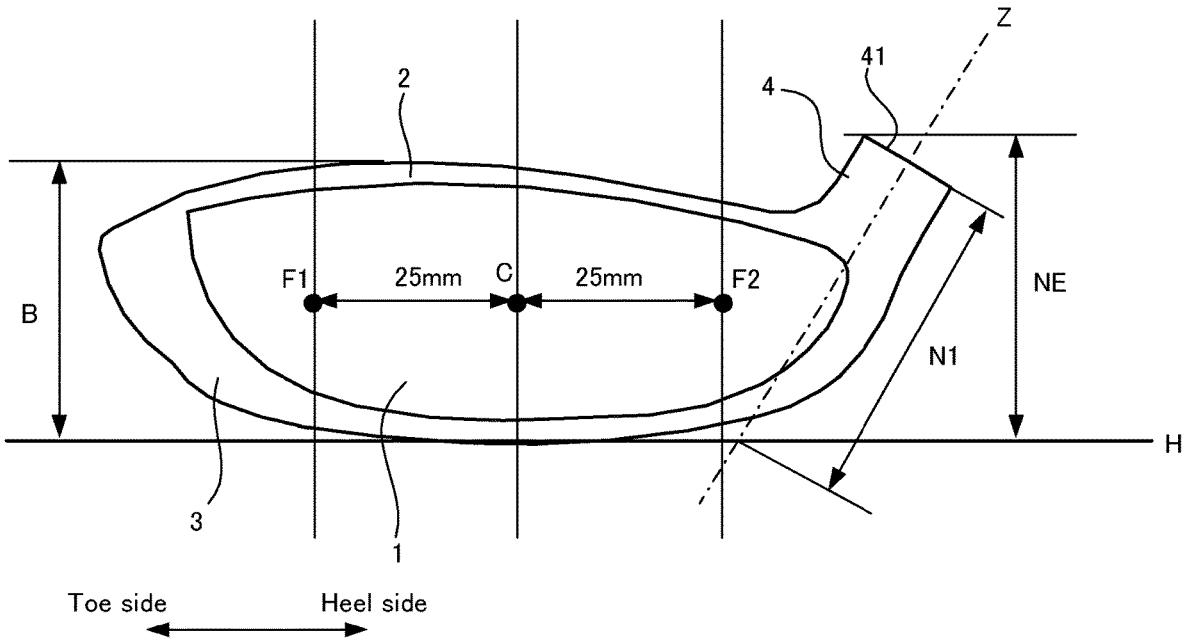
FIG. 7 is a front view of the head in FIG. 1.

Next, the shape of the head 100 according to the present embodiment will be described, with reference to FIGS. 5 to 7. FIG. 5 is a side view of the head, FIG. 6 is a cross-sectional view taken along a B-B line in FIG. 5, and FIG. 7 is a front view of the head. First, the surface shape of the sole portion will be described. First, as shown in FIGS. 5 to 7, the line of intersection between the abovementioned plane P1 and the surface of the sole portion 3 is prescribed as a reference sole line of intersection. Three points corresponding to the face center C, a point F1 that is 25 mm from the face center C on the toe side and a point F2 that is 25 mm from the face center C on the heel side, that is, points K1, K2 and K3, are then prescribed on this reference sole line of intersection. Specifically, the intersections between planes respectively passing through the face center C, the point F1 and the point F2 and extending vertically in the face-back direction from a setting surface H will be the points K1, K2 and K3. When a circular arc (hereinafter, sole portion surface circular arc M) passing through these points K1, K2 and K3 is prescribed, the surface shape of the sole portion 3 is determined, such that a curvature radius of this sole portion surface circular arc M is 5.0 to 6.0 inches (127.0 to 152.4 mm).

Next, the relationship between a head height and a neck height of the head 100 according to the present embodiment will be described. As shown in FIG. 7, a height B (hereinafter, head thickness) from the setting surface H to the uppermost point of the head excluding the hosel portion 4, that is, the uppermost point of the crown portion 2, is prescribed, with the head in the reference state. Also, with the head in the reference state, a height NE (hereinafter, neck height) from the setting surface H to the uppermost point of the hosel portion 4 is prescribed. The shape of the head is then designed such that the relationship of these heights satisfies NE/B≤1.25.

Here, the head thickness B is, for example, preferably 40 mm or less, more preferably 39 mm or less, and particularly preferably 38 mm or less. The height of the face portion 1 thereby decreases and the position of the face center C becomes lower. As a result, when hitting a ball placed on the setting surface H, it becomes easier to hit the ball near the face center C and carry distance can be improved. Also, the neck height NE is preferably 44 mm or less, more preferably 42.5 mm or less, and particularly preferably 41 mm or less. Lowering of the center of gravity of the head can thereby be achieved. Also, a neck length N1 shown in FIG. 7 is 40 to 46.5 mm, for example. The neck length N1 is a length in the direction of the center axis line Z of the hosel portion 4, and is the distance from the intersection between the center axis line Z and the setting surface H to the opening of the insertion hole 41.

Next, the relationship between the head thickness of the head 100 and the height of a rear end portion of the head according to the present embodiment will be described. As shown in FIG. 5, a height T (hereinafter, head rear end thickness) from the setting surface H at an end portion of the head in the face-back direction, that is, an end portion (hereinafter, head rear end point R) positioned furthest on the back side is prescribed with the head in the reference state. The shape of the head is designed so that these relationships satisfy T/B≤0.3.

Also, the head rear end thickness T is, for example, preferably 13 mm or less, more preferably 12 mm or less, and particularly preferably 11 mm or less. Lowering of center of gravity of the head can thereby be achieved.

In addition, with the head in the reference state, a height SH from the setting surface H to the sweet spot SS is preferably 24.5 mm or less, more preferably 23.5 mm or less, and particularly preferably 22.5 mm or less. The sweet spot SS thereby approaches the face center C. In other words, since the face center C that is located in a vicinity of a real strike point approaches the sweet spot SS, the launch angle is large and the amount of spins is small. As a result, carry distance can be increased.

Also, the height (hereinafter, center of gravity height GH) from the setting surface H to the center of gravity G of the head, is preferably 17 mm or less, more preferably 16 mm or less, and particularly preferably 15 mm or less.

Furthermore, the length (hereinafter, center of gravity depth X) in the face-back direction between a point on the head in the reference state that is furthest on the face side and the center of gravity G is preferably 28 mm or more, more preferably greater than or equal to 29 mm, and particularly preferably greater than or equal to 30 mm. The launch angle can thereby be enlarged.

4. Manufacturing Method of Golf Club Head

Next, an example of the manufacturing method of the above golf club head will be described. First, the above-mentioned head main body 101 and face member 102 are prepared. A head main body 101 and a face member 102 such as described above can be produced with various methods. For example, the head main body 101 can be manufactured by casting such as a well-known lost wax precision casting process. Also, the face member 102 can be manufactured by a method such as forging, plate pressing or casting, for example. Also, the pre-processing plate of the face member 102 that is used at this time is processed such that the rolling direction substantially coincides with the direction from an upper portion on the toe side of the face portion 1 to a lower portion on the heel side.

The golf club head is then completed when predetermined coating is performed after joining these portions by welding (TIG (tungsten inert gas) welding, plasma welding, laser welding, brazing, etc.), for example.

5. Features

The above embodiment enables the following effects to be obtained.

(1) Since the shape of the sole portion 3 is designed such that the curvature radius of the sole portion surface circular arc M will be 5.0 to 6.0 inches, the following effects can be obtained. That is, when the curvature radius is larger than 6.0 inches, the contact portion between the head 100 and the setting surface H when hitting the ball without teeing up, for example, becomes too large, and there is a risk that the frictional resistance between the sole portion 3 and the setting surface H when the club is swung through will increase. As a result, there is a risk that the swing speed at impact will drop.

On the other hand, when the curvature radius is less than 5.0 inches, the positions of the points K2 and K3 become too high relative to the point K1 on the reference sole line of intersection, and there is a risk of not being able to achieve lowering of the center of gravity. Also, there is also a risk that the length of the face portion 1 in the up-down direction on the toe side and the heel side will decrease.

Therefore, by setting the curvature radius of the sole portion surface circular arc M to 5.0 to 6.0 inches, the club becomes easy to swing and lowering of the center of gravity can be achieved. Also, since the length of the face portion 1 in the up-down direction on the toe side and the heel side can be increased, the toe side and the heel side of the face portion 1 flex more easily. As a result, the high rebounding area can be expanded on the toe and heel sides.

(2) With the head 100 in the reference state, the shape of the head is designed such that the relationship between the head thickness B and the neck height NE satisfies NE/B≤1.25, and thus the neck height NE decreases. The center of gravity of the head can thereby be further lowered.

(3) With the head 100 in the reference state, the shape of the head is designed such that the relationship between the head thickness B and the head rear end thickness T satisfies T/B≤0.3, and thus the rear end portion of the head is further lowered. The center of gravity of the head can thereby be further lowered.

6. Variations

Although an embodiment of the present invention has been described above, the present invention is not limited to the above embodiment, and various modifications can be made without departing from the spirit of the invention. Also, the following variations can be appropriately combined. Modifications such as the following can be made, for example.

6-1

Forms other than the abovementioned shape of the sole portion 3 are not particularly limited, and various recesses, protrusions and the like can be formed in the crown portion 2, for example.

6-2

The head according to the above embodiment has a cup face structure, but other forms are possible. For example, the head can be constituted by fitting the crown portion 2 into an opening for the crown portion formed in a head main body that includes the face portion 1 and the sole portion 3. Also, a cup face structure need not be adopted, and the head can be constituted by fitting a plate-like face member into an opening formed in the face portion 1 and welding the face member to the head main body.

Working Examples

Hereinafter, working examples of the present invention will be described. The present invention is, however, not limited to the following working examples.

(1) Preparation of Working Examples and Comparative Examples

Here, fairway woods (FW #5) having five types of heads with a head thickness of 36.8 mm, a neck height of 40.3 mm, a head rear end thickness of 9.2 mm and a neck length of 43.0 mm were prepared. These five types of fairway woods mainly differ in the curvature radius of the abovementioned sole portion surface circular arc and the center of gravity height, as will be described below.

TABLE 1

| | Working Example 1 | Working Example 2 | Working Example 3 | Comparative Example 1 | Comparative Example 2 |
|---|---|---|---|---|---|
| Curvature radius of sole portion surface circular arc | 5.5 | 5.0 | 6.0 | 4.5 | 6.5 |
| Center of gravity | 13.2 | 13.3 | 13.1 | 13.4 | 13.0 |

(2) Evaluation Tests

The following tests were carried out on these five types of fairway woods.

(2-1) Carry Distance Test

The clubs of working examples 1 to 3 and comparative examples 1 and 2 were mounted in a swing machine manufactured by Golf Laboratory. 20 balls were hit with each golf club, the distance (carry) to where the balls landed was measured, and the average was calculated. The condition of impact was a head speed of 41 m/sec, and tests were under substantially windless conditions.

(2-2) Swing Through Test

Ten golfers hit balls in the rough with the clubs of working examples 1 to 3 and comparative examples 1 and 2, and sensory evaluation was performed with regard to resistance at the time of swinging the club through. That is, points were awarded in accordance with the following evaluation criteria, and the average points of the ten golfers were calculated.

A evaluation (four points): Feel no resistance at all when swinging through.

B evaluation (three points): Feel substantially no resistance when swinging through.

C evaluation (two points): Feel slight resistance when swinging through.

D evaluation (one point): Feel considerable resistance when swinging through.

The results of the above two tests were as follows.

TABLE 2

| | Working Example 1 | Working Example 2 | Working Example 3 | Comparative Example 1 | Comparative Example 2 |
|---|---|---|---|---|---|
| Carry distance | 192.8 | 192.7 | 193.0 | 192.4 | 193.1 |
| Swing through test | 2.8 | 3.1 | 2.4 | 3.3 | 1.5 |

The above results indicate that since the curvature radius of the sole portion surface circular arc is 5 to 6 inches and the center of gravity is moderately low in working examples 1 to 3, carry distance is extended over comparative example 1. On the other hand, since the comparative example 2 has a low center of gravity, the carry distance is extended but since the curvature radius of the sole portion surface circular arc is large, resistance tends to be felt when swinging the club through. Accordingly, it is evident that the carry distance of the golf club heads according to working examples 1 to 3 is extended, and, moreover, strong resistance is not felt when the club is swung through.

LIST OF REFERENCE NUMERALS

1 Face portion
2 Crown portion
3 Sole portion
4 Hosel portion

What is claimed is:

1. A golf club head comprising:
a face portion;
a crown portion;
a sole portion; and a hosel portion with an insertion hole into which a shaft can be inserted, wherein a reference sole line of intersection which is a line of intersection between a plane containing a central axis of the shaft and perpendicular to a setting surface and a surface of the sole portion with the golf club head in a reference state is prescribed, and a curvature radius of a circular arc that passes through three points on the reference sole line of intersection respectively corresponding to a face center, a position 25 mm from the face center on a toe side and a position 25 mm from the face center on a heel side is 5.0 to 6.0 inches, a relationship between a height T of a back-side end portion of the golf club head in the reference state from the setting surface and a height B from the setting surface of the golf club head in the reference state to an uppermost point of the crown portion satisfies $T/B \leq 0.3$, and a relationship between a height NE from the setting surface of the golf club head in the reference state to an uppermost point of the hosel portion and the height B satisfies $NE/B \leq 1.25$, the height T is 9.2 mm or more and 13 mm or less, the height B is 36.8 mm or more and 40 mm or less, the height NE is 40.3 mm or more and 44 mm or less, a height GH of a center of gravity of the golf club head in the reference state from the setting surface is 13.1 mm or more and 17 mm or less, a height SH of a sweet spot of the face portion from the setting surface is the height GH or more and 24.5 mm or less, a length X in a face-back direction between a face-side end portion of the golf club head in the reference state and the center of gravity is 28 mm or more, a neck length N1 is 40 to 46.5 mm, the neck length being a length along a center axis line direction of the hosel portion and being a distance between an intersection of the center axis line and the setting surface and the insertion hole, and the volume of the golf club head is from 90 $cm^3$ to 470 $cm^3$ inclusive.

2. The golf club head according to claim 1, comprising:

a head main body having a back-side crown portion that constitutes a back-side part of the crown portion and a back-side sole portion that constitutes a back-side part of the sole portion, and having an opening enclosed by the back-side crown portion and the back-side sole portion; and a cup-shaped face member having the face portion and a peripheral portion extending from a periphery of the face portion, wherein the peripheral portion constitutes a face-side part of the crown portion and a face-side part of the sole portion, and the face member is configured to close off the opening in the head main body.

3. The golf club head according to claim 1, wherein the golf club head is a fairway wood or a hybrid.

* * * * *